US010074469B2

(12) United States Patent
Scales et al.

(10) Patent No.: US 10,074,469 B2
(45) Date of Patent: Sep. 11, 2018

(54) MAGNETIC MATERIALS POLARIZED AT AN OBLIQUE ANGLE

(71) Applicant: Apple Inc., Cupertino, CA (US)

(72) Inventors: Timothy W. Scales, Cupertino, CA (US); Hao Zhu, Cupertino, CA (US); Samuel G. Smith, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/174,833

(22) Filed: Jun. 6, 2016

(65) Prior Publication Data

US 2017/0352459 A1 Dec. 7, 2017

(51) Int. Cl.
*H01F 7/02* (2006.01)
*H01F 41/02* (2006.01)

(52) U.S. Cl.
CPC ..... *H01F 7/021* (2013.01); *H01F 41/0253* (2013.01)

(58) Field of Classification Search
CPC ... H01F 7/00; H01F 7/02; H01F 41/01; H01F 1/00; B65D 5/52; B65D 525/24; G06F 1/16; H05K 5/02
USPC ..... 335/306
See application file for complete search history.

(56) References Cited

U.S. PATENT DOCUMENTS 2,152,955 A 4/1939 Coyne
2,803,762 A 8/1957 Urschler et al.
5,812,356 A 9/1998 O'Connor
5,818,222 A 10/1998 Ramsden
5,917,774 A 6/1999 Walkow et al.
5,921,783 A * 7/1999 Fritsch ..... H01R 13/703 439/38
6,339,419 B1 1/2002 Jolly et al.
6,366,440 B1 * 4/2002 Kung ..... E05C 19/16 361/147
6,561,815 B1 5/2003 Schmidt
(Continued)

FOREIGN PATENT DOCUMENTS

CN 102035440 4/2011
DE 1029908 5/1958
(Continued)

OTHER PUBLICATIONS

U.S. Appl. No. 13/188,428, filed Jul. 21, 2011, Bilbrey et al.
(Continued)

*Primary Examiner* — Shawki S Ismail
*Assistant Examiner* — Lisa Homza
(74) *Attorney, Agent, or Firm* — Dickinson Wright RLLP

(57) ABSTRACT

An oblique angle polarized magnet includes a rectangular magnetized permanent magnet having a grain direction, an attraction surface, and a magnetic primary field line that is orthogonal to the grain direction but non-orthogonal to the attraction surface. The oblique angle polarized magnet may be used in a magnetically positioned apparatus, such as a tablet computing device cover operable as a stand for the tablet computing device. The magnetically positioned apparatus may be configured to assume a position where first and second magnets are oriented in a non-parallel orientation such that the first and second surfaces of the magnets oriented at an acute angle with respect to each other. The magnets may facilitate the position.

22 Claims, 17 Drawing Sheets

(56) References Cited

U.S. PATENT DOCUMENTS 6,653,919 B2 * 11/2003 Shih-Chung ..... G06F 1/162 24/303
6,929,291 B2 * 8/2005 Chen ..... E05C 19/16 292/251.5
7,066,785 B2 6/2006 Park et al.
7,170,205 B2 1/2007 Won et al.
7,242,786 B2 7/2007 Asnes
7,288,934 B1 * 10/2007 Ikarashi ..... G01R 33/09 324/207.21
7,561,142 B2 7/2009 Shahoian et al.
7,817,003 B2 10/2010 Fullerton et al.
7,834,729 B2 11/2010 Fullerton et al.
7,868,721 B2 1/2011 Fullerton et al.
7,915,986 B2 * 3/2011 Lu ..... H04M 1/0216 16/221
8,013,847 B2 9/2011 Anastas
8,018,105 B2 9/2011 Erixon et al.
8,138,869 B1 * 3/2012 Lauder ..... G06F 1/1613 24/303
8,143,982 B1 * 3/2012 Lauder ..... G06F 1/1626 206/320
8,177,560 B2 5/2012 Rohrbach et al.
8,179,219 B2 5/2012 Fullerton et al.
8,242,641 B2 8/2012 Bae et al.
8,242,868 B2 * 8/2012 Lauder ..... G06F 1/1647 24/303
8,253,518 B2 * 8/2012 Lauder ..... G06F 1/1647 206/320
8,260,381 B2 * 9/2012 Lee ..... H04M 1/0245 455/556.1
8,289,115 B2 * 10/2012 Cretella, Jr. ..... G06F 1/1626 206/320
8,344,836 B2 * 1/2013 Lauder ..... H01F 7/04 206/320
8,348,678 B2 1/2013 Hardisty et al.
8,363,870 B2 1/2013 Asnes
8,390,411 B2 * 3/2013 Lauder ..... G06F 1/1626 206/320
8,395,465 B2 * 3/2013 Lauder ..... G09G 5/003 206/320
8,400,410 B2 3/2013 Taylor et al.
8,576,034 B2 11/2013 Bilbrey et al.
8,593,018 B2 11/2013 Furuich et al.
8,683,830 B2 4/2014 Conti
8,774,577 B2 7/2014 Benjamin et al.
8,781,273 B2 7/2014 Benjamin et al.
8,963,666 B2 2/2015 Bilbrey et al.
9,035,872 B2 * 5/2015 Brown ..... G06F 3/01 345/156
9,226,559 B1 1/2016 Diebel et al.
2002/0147026 A1 * 10/2002 Hsieh ..... H04M 1/0216 455/575.3
2005/0097711 A1 * 5/2005 Halstead ..... A45C 1/06 24/303
2005/0194384 A1 * 9/2005 Petit ..... A45C 13/1069 220/230
2006/0049010 A1 3/2006 Olien et al.
2006/0151990 A1 7/2006 Cowburn
2007/0103266 A1 * 5/2007 Wang ..... H01F 7/0242 335/285
2007/0138806 A1 * 6/2007 Ligtenberg ..... E05C 19/16 292/251.5
2008/0158800 A1 * 7/2008 Aoyagi ..... G06F 1/1616 361/679.01
2009/0128503 A1 5/2009 Grant et al.
2011/0116214 A1 * 5/2011 Liu ..... G06F 1/1679 361/679.01
2012/0023597 A1 1/2012 Bilbrey et al.
2012/0032765 A1 2/2012 Bilbrey et al.
2012/0069540 A1 * 3/2012 Lauder ..... G06F 1/1626 361/807
2012/0308981 A1 * 12/2012 Libin ..... G09B 3/00 434/362
2013/0076652 A1 3/2013 Leung
2016/0233911 A1 * 8/2016 Sirichai ..... A45C 11/00

FOREIGN PATENT DOCUMENTS

FR 2944613 10/2010
JP 2002192073 7/2002
KR 20100138219 12/2010

OTHER PUBLICATIONS

U.S. Appl. No. 13/188,432, filed Jul. 21, 2011, Bilbrey et al.
U.S. Appl. No. 13/188,436, filed Jul. 21, 2011, Bilbrey et al.
U.S. Appl. No. 13/188,429, filed Jul. 21, 2011, Bilbrey et al.
U.S. Appl. No. 13/247,994, filed Sep. 28, 2011, Leung.

* cited by examiner

MAGNETIC MATERIALS POLARIZED AT AN OBLIQUE ANGLE

FIELD

The described embodiments relate generally to magnets. More particularly, the present embodiments relate to magnets that are oblique angle polarized.

BACKGROUND

Magnets are used in a variety of different devices to perform a variety of different functions. Magnets may be used to attach elements, position elements, align elements, and/or to accomplish a variety of other purposes.

In general, magnets have a magnetic primary field line that is orthogonal to their geometry. In other words, the magnetic primary field line is orthogonal to an attraction surface of the magnet. When the magnet is positioned parallel to and facing the attraction surface of another magnet, the two magnets efficiently attract each other.

For example, two halves of a magnetic clasp may include two orthogonal polarized magnets that have facing parallel attraction surfaces when the two halves touch. Attraction between the magnets may operate to keep the magnetic clasp closed.

SUMMARY

The present disclosure relates to oblique angle polarized magnets that include a rectangular magnetized permanent magnet having a grain direction, an attraction surface, and a magnetic primary field line that is orthogonal to the grain direction but non-orthogonal to the attraction surface. An oblique angle polarized magnet may be used in a magnetically positioned apparatus. The magnetically positioned apparatus may be configured to assume a position where first and second magnets are oriented in a non-parallel orientation such that the first and second surfaces of the magnets oriented at an acute angle with respect to each other. The magnets may facilitate the position.

In various embodiments, a magnetically positioned apparatus utilizing magnets to maintain a configuration includes a first magnet and a second magnet. The first magnet includes a first surface and a first magnetic material having a first grain direction that defining at a non-right, non-zero angle with respect to the first surface. The second magnet includes a second magnetic material having a second surface. The magnetically positioned apparatus is configured to assume a position where the first and second magnets are oriented in a non-parallel orientation such that the first and second surfaces are oriented at an acute angle with respect to each other. The first and second magnets facilitate the position.

In some examples, the second magnetic material has a second grain direction that is orthogonal to the second surface. In various implementations of examples, the first magnet defines a first and second pole and one of the first and second poles emit magnetic flux at an oblique angle to the first surface. The first pole may be oriented at approximately a 90 degree angle from the second surface when the magnetically positioned apparatus is in the position. In numerous examples, the second magnetic material has a second grain direction defining a non-right, non-zero angle with respect to the second surface.

In various examples, the magnetically positioned apparatus is a cover for an electronic device. In some implementations of such examples, the cover is coupleable to the electronic device. In numerous examples of such implementations, the cover includes a first housing portion and a second housing portion where the first magnet is attached to the second housing portion, the second magnet is attached to the second housing portion, and the first and second housing portions are oriented in a non-parallel orientation when the cover is in the position. The cover may operable as a stand for the electronic device when in the position. In such examples, the cover may further include a third housing portion flexibly coupled to the second housing portion; the first housing portion may be flexibly coupled to the second housing portion; and the first housing portion, the second housing portion, and the third housing portion may form a triangle when the cover is in the position. The first magnet may be embedded in the first housing portion.

In some embodiments, a magnetic element includes a rectangular magnetized permanent magnet having a grain direction, an attraction surface, and a magnetic primary field line parallel to the grain direction and non-orthogonal to the attraction surface. In various examples, the rectangular magnetized permanent magnet is a non-cubic parallelepiped. In numerous examples, the rectangular magnetized permanent magnet includes at least one of neodymium, iron, or boron. In some examples, the rectangular magnetized permanent magnet is non-square. In various examples, the rectangular magnetized permanent magnet is enclosed in a housing.

In numerous embodiments, a method for creating a magnetic element includes forming a mass of magnetic material having a grain direction, removing material from the mass to form a structure having an external surface, such that the grain direction is non-orthogonal to the external surface, and magnetizing the structure by subjecting the mass to a magnetic field. The grain direction may be aligned by the magnetic field.

In some examples, the method may further include separating the structure into a set of magnets, each of the set defining a respective external surface that is non-orthogonal to the grain direction. The magnetic element may be a non-cubic parallelepiped.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Reference will now be made in detail to representative embodiments illustrated in the accompanying drawings. It should be understood that the following descriptions are not intended to limit the embodiments to one preferred embodiment. To the contrary, it is intended to cover alternatives, modifications, and equivalents as can be included within the spirit and scope of the described embodiments as defined by the appended claims.

The description that follows includes sample systems, methods, and apparatuses that embody various elements of the present disclosure. However, it should be understood that the described disclosure may be practiced in a variety of forms in addition to those described herein.

The following disclosure relates to oblique angle polarized magnets or other magnetic elements. Such magnets may include a rectangular magnetized permanent magnet having a grain direction, an attraction surface (which may be an exterior surface), and a magnetic primary field line that is orthogonal to the grain direction but non-orthogonal to the attraction surface. The "primary field line" is the line defined by the magnetic field or flux that passes through a center of the magnet's north and south poles, e.g., that essentially defines a center of the magnet's magnetic field. With respect to a two-dimensional depiction of a magnetic field, the magnetic field curves in a first direction on a first side of the magnetic field line and a second direction on a second side of the magnetic field line.

An oblique angle polarized magnet may be used in a magnetically positioned apparatus, such as a tablet computing device cover operable as a stand for the tablet computing device. The magnetically positioned apparatus may be configured to assume a position where first and second magnets are oriented in a non-parallel orientation such that the first and second surfaces of the magnets oriented at an acute angle with respect to each other. The magnets may facilitate the position.

These and other embodiments are discussed below with reference to FIGS. 1A-13. However, those skilled in the art will readily appreciate that the detailed description given herein with respect to these Figures is for explanatory purposes only and should not be construed as limiting.

Within this disclosure, the term orthogonal refers to of or involving right angles or substantially right angles. For example, within this disclosure, orthogonal involves angles of 90 degrees plus or minus 5 degrees, such as 89.5 degrees.

Figure 1A:
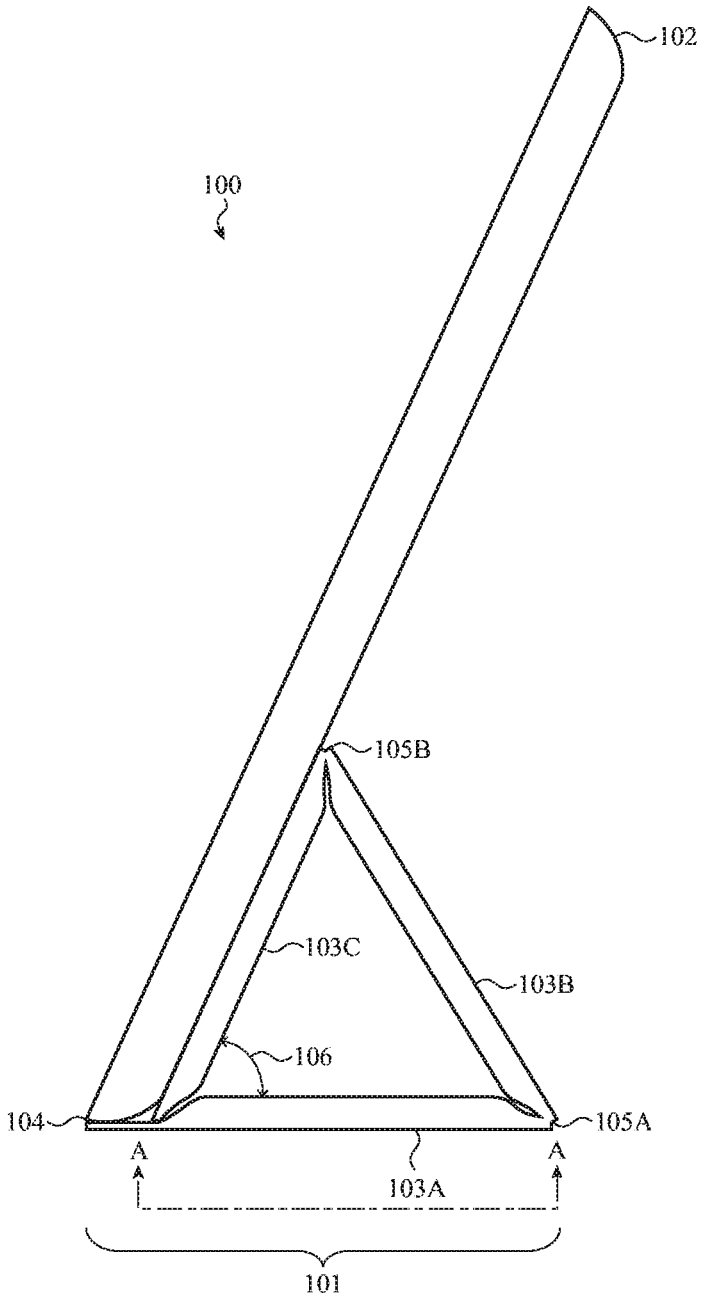
FIG. 1A depicts a system including an electronic device and an associated magnetically positioned apparatus.

FIG. 1A depicts a system 100 including an electronic device 102 and an associated magnetically positioned apparatus 101, which may be coupled to the electronic device 102 via a connector 104 (such as a magnetic clasp). The magnetically positioned apparatus 101 may include an oblique angle polarized magnet that allows the magnetically positioned apparatus 101 to be positioned in a configuration, such as the configuration shown.

In this example, the magnetically positioned apparatus 101 includes a number of housing portions 103A, 103B, 103C connected by a number of joints 105A, 105B. The joints 105A, 105B allow the magnetically positioned apparatus 101 to be manipulated such that the housing portions 103A, 103B, 103C are operable to move with respect to each other. For example, the magnetically positioned apparatus 101 may be manipulated to position the housing portions 103A, 103B, 103C in a triangular arrangement so that the magnetically positioned apparatus 101 is positioned in the configuration shown. Magnets or other magnetic elements embedded within and/or otherwise attached to the housing portions 103A, 103B, 103C may maintain the housing portions 103A, 103B, 103C in the configuration shown or facilitate the position shown. For example, attraction (and/or repulsion in other implementations) between magnets embedded within a first housing portion 103A and a second housing portion 103C may facilitate the illustrated non-parallel orientation position shown by bringing the magnetically positioned apparatus 101 toward the position shown, maintaining the first housing portion 103A and the second housing portion 103C in the position shown, and so on. The first and second housing portions 103A, 103C may be maintained at an angle 106 with respect to each other, shown as an approximately 67.5 degree angle. When the magnetically positioned apparatus 101 is positioned in the configuration shown such that the housing portions 103A, 103B, 103C are arranged in the triangular arrangement, the magnetically positioned apparatus 101 may operate as a stand for the electronic device 102.

The joints 105A, 105B also allow the magnetically positioned apparatus 101 to unfold and straighten. This allows the magnetically positioned apparatus 101 to rotate on the connector 104 to be used as a cover for the electronic device 102. Magnets or other magnetic elements of the housing portions 103A, 103B, 103C may be operable to magnetically attach to the electronic device 102 to facilitate maintenance of the magnetically positioned apparatus 101 in place when operating as a cover for the electronic device 102.

Figure 1B:
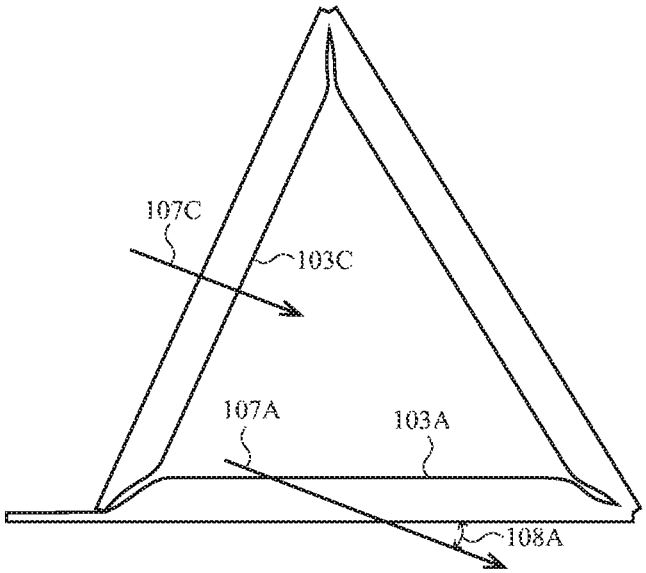
FIG. 1B depicts a first example of the system of FIG. 1A showing magnetic primary field lines of magnets included in the magnetically positioned apparatus where one of the magnets is oblique angle polarized.

FIG. 1B depicts a first example of the system 100 of FIG. 1A showing magnetic primary field lines 107A, 107C of magnets included in the magnetically positioned apparatus 101 where one of the magnets is oblique angle polarized. In this first example, the magnet embedded in the first housing portion 103A is oblique angle polarized whereas the magnet embedded in the second housing portion 103C is orthogonal polarized. Thus, the magnetic primary field line 107A of the magnet included in the first housing portion 103A is non-orthogonal to the geometry of the magnet, oblique at an angle 108A (shown as approximately 22 degrees) with respect to the geometry of the magnet and the first housing portion 103A, whereas the magnetic primary field line 107C included in the second housing portion 103C is orthogonal to the geometry of that magnet, substantially perpendicular with respect to the geometry of that magnet and the second housing portion 103C.

Thus, the magnet included in the first housing portion 103A and the magnet included in the second housing portion 103C are oriented in a non-parallel orientation while attraction surfaces of the magnets are oriented at an acute angle with respect to one another. Further, the primary field line 107A of the magnet included in the first housing portion 103A is at an approximately 89.5 degree angle to the magnetic primary field line 107C of the magnet included in the second housing portion 103C (the 67.5 degree angle of the first housing portion 103A to the second housing portion 103C plus the 22 degree angle of the primary field line 107A of the magnet included in the first housing portion 103A to the first housing portion 103A).

Figure 1C:
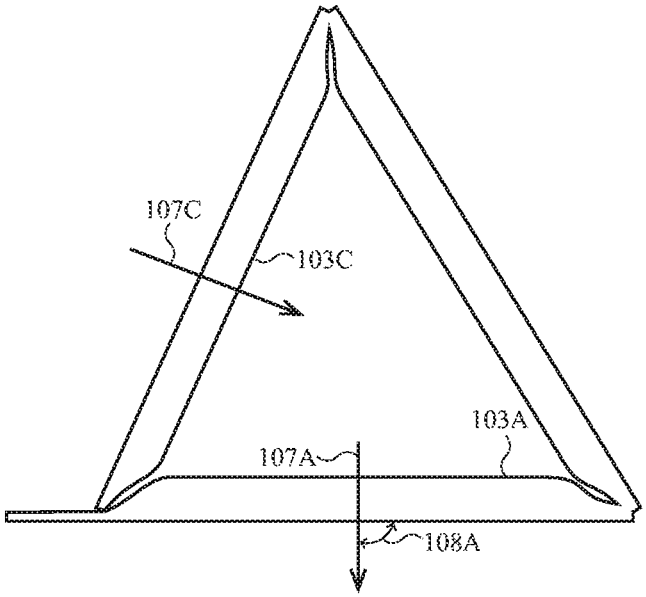
FIG. 1C depicts a second example of the system of FIG. 1A showing magnetic primary field lines of magnets included in the magnetically positioned apparatus where the two magnets are orthogonal polarized.

By way of contrast with the first example of the system 100 illustrated in FIG. 1B, FIG. 1C depicts a second example of the system 100 of FIG. 1A showing magnetic primary field lines 107A, 107C of magnets included in the magnetically positioned apparatus 101 where the two magnets are orthogonal polarized. As such, both magnetic primary field lines 107A, 107C are orthogonal to the geometry of the respective magnet, substantially perpendicular with respect to the geometry of the respective magnet and the respective housing portion 103A, 103C.

Regardless, the first example of the system 100 illustrated in FIG. 1B is configured such that the magnetic primary field lines 107A, 107C are aligned approximately parallel (and the angles 106 and 108A combine to approximately 90 degrees) when the magnetically positioned apparatus 101 is positioned in the configuration whereas the second example of the system 100 illustrated in FIG. 1C is configured such that the magnetic primary field lines 107A, 107C are misaligned (and the angles 106 and 108A combine to well over 90, approximately 180, degrees). As the polarities of the magnets of the first and second housing portions 103A, 103C are opposite, aligning the magnetic primary field lines 107A, 107C approximately parallel positions the magnets at the maximum possible attraction between the respective magnetic fields. By way of contrast, the misaligned magnetic primary field lines 107A, 107C of the second example of the system 100 illustrated in FIG. 1C positions the magnets such that very little of the magnetic fields are able to attract each other. As a result, the system 100 illustrated in FIG. 1C makes less efficient use of the magnetic fields and substantially stronger magnets would need to be used in order to maintain the magnetically positioned apparatus 101 in the configuration.

Thus, use of oblique angle polarized magnets or other magnetic elements frees device configuration and design from concerns regarding geometry and orientation of magnets by freeing magnetic primary field lines 107A, 107C from such geometry and orientation. This may enable use of smaller magnets, as the magnets may be used more efficiently in non-parallel facing orientations, freeing up more space in devices for non-magnet components.

Figure 1D:
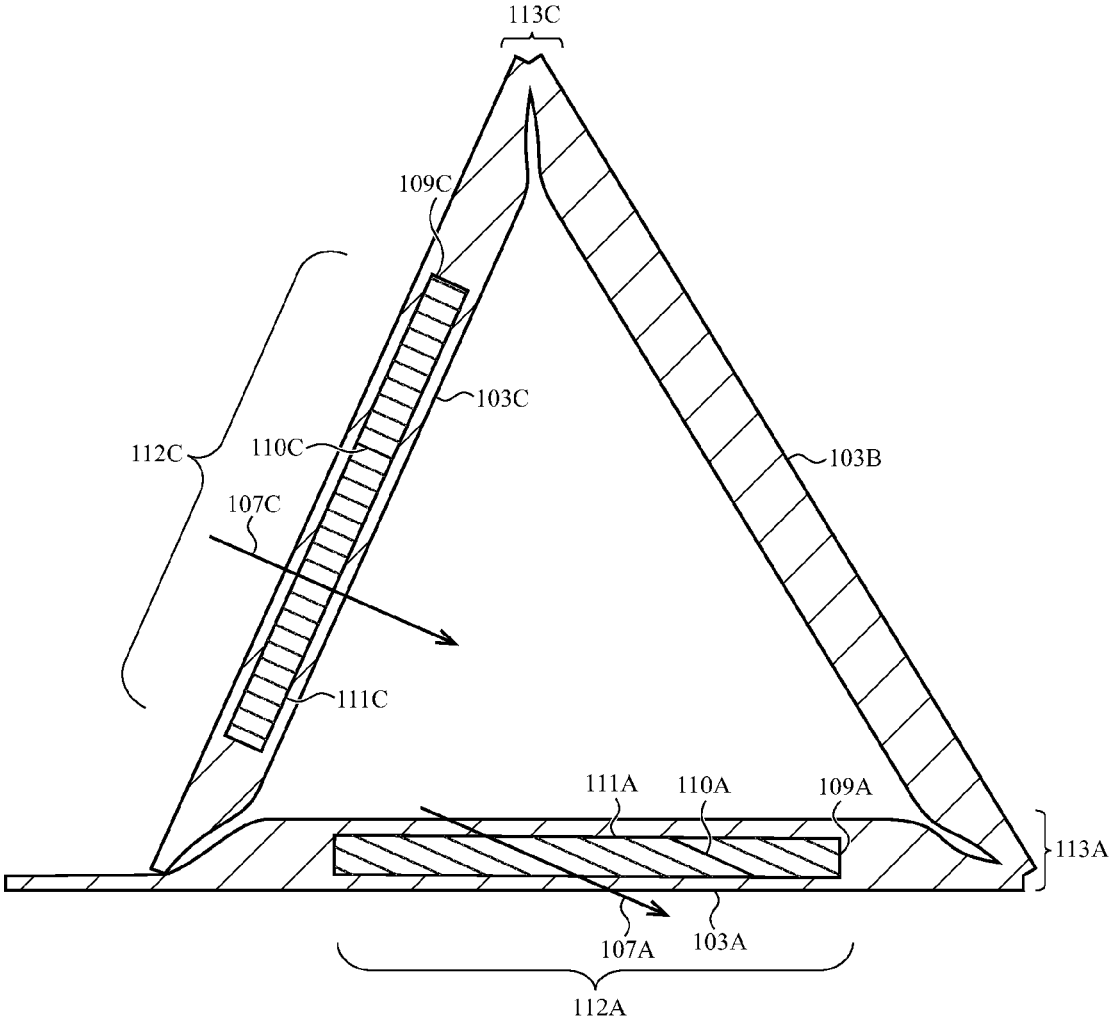
FIG. 1D depicts a simplified cross-sectional view of the magnetically positioned apparatus of FIG. 1B, taken along line A-A shown in FIG. 1A.

FIG. 1D depicts a simplified cross-sectional view of the magnetically positioned apparatus 101 of FIG. 1B, taken along line A-A shown in FIG. 1A. A first magnet 109A is embedded in the first housing portion 103A and a second magnet 109C is embedded in the second housing portion 103C. The first magnet 109A is a non-cubic parallelepiped that is rectangular in cross-section and has a length 112A, a width 113A, a magnetic primary field line 107A, a grain direction 110A, and an attraction surface 111A. The magnetic primary field line 107A is aligned with the grain direction 110A, both of which are non-orthogonal to the length 112A and the attraction surface 111A. Similarly, the second magnet 109C is a rectangular parallelepiped and has a length 112C, a width 113C, a magnetic primary field line 107C, a grain direction 110C, and an attraction surface 111C. Similar to that of the first magnet 109A, the magnetic primary field line 107C is aligned with the grain direction 110C. Contrasted with those of the first magnet 109A, the magnetic primary field line 107C and the grain direction 110C are both orthogonal to the length 112C and the attraction surface 111C.

Although FIGS. 1A-1D illustrate and describe use of an oblique polarized magnet with a particular magnetically positioned apparatus 101, it is understood that this is an example. In various implementations, various numbers of oblique polarized magnets may be used in a variety of different devices and/or alone without departing from the scope of the present disclosure. For example, oblique angle polarized magnets may be included in the band of a wearable device such as a smart watch to facilitate positioning and/or maintaining the band in a circular or other configuration when not currently being worn by a user. Various arrangements are possible and contemplated.

Further, although the electronic device 102 is depicted as a tablet computing device, it is understood that this is an example. The magnetically positioned apparatus 101 and/or another device that uses oblique angle polarized magnets may be used with or without a variety of different electronic devices. Such electronic devices 102 may include, but are not limited to, laptop computing devices, desktop computing devices, mobile computing devices, smart phones, wearable electronic devices, digital media players, displays, printers, cellular telephones, and so on.

Figure 2A:
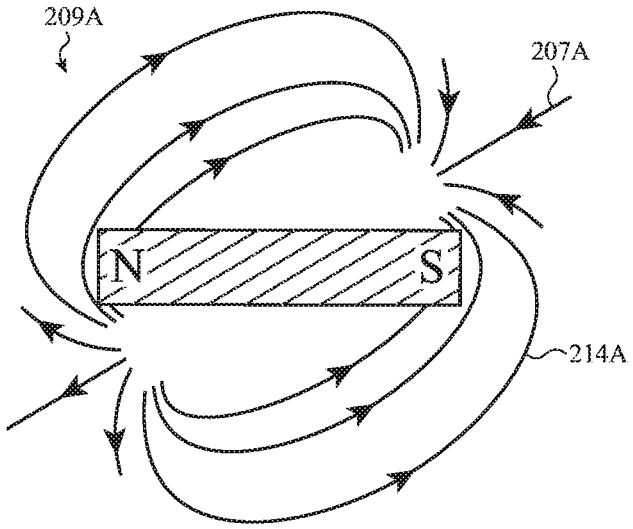
FIG. 2A depicts an example of an oblique angle polarized magnet showing the magnetic primary field line and a simplified magnetic flux flow.
Figure 2B:
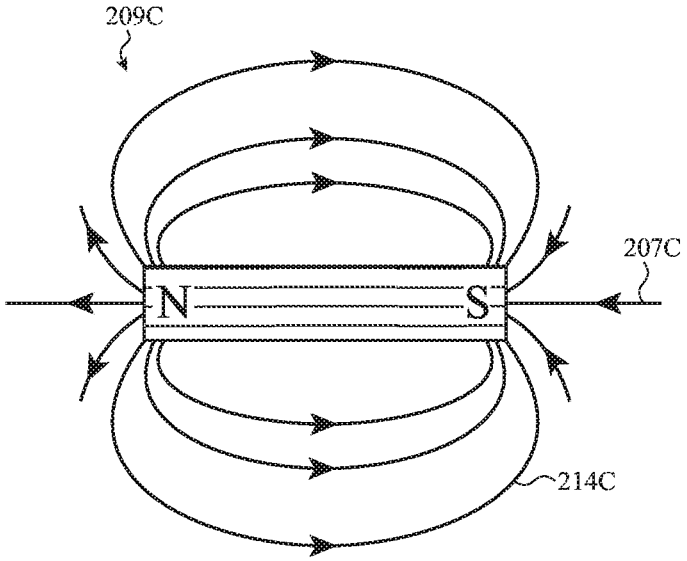
FIG. 2B depicts an example of an orthogonal polarized magnet showing the magnetic primary field line and a simplified magnetic flux flow.

FIG. 2A depicts an example of an oblique angle polarized magnet 209A showing the magnetic primary field line 207A and a simplified magnetic flux flow 214A. The grain direction of the oblique angle polarized magnet 209A is parallel to the magnetic primary field line 207A. By way of contrast, FIG. 2B depicts an example of an orthogonal polarized magnet 209C showing the magnetic primary field line 207C and a simplified magnetic flux flow 214C. The grain direction of the orthogonal polarized magnet 209C is parallel to the magnetic primary field line 207C. As shown, the magnetic primary field line 207A and the magnetic flux flow 214A are non-orthogonal with respect to the illustrated length and width of the oblique angle polarized magnet 209A. Thus, the simplified magnetic flux flow 214A flows through a middle portion of the oblique angle polarized magnet 209A on one side and outside of the oblique angle polarized magnet 209A on the other. By way of contrast, the magnetic primary field line 207C and the magnetic flux flow 214C are orthogonal with respect to the illustrated length and width (e.g., parallel to the illustrated length and perpendicular to the illustrated width) of the orthogonal polarized magnet 209C. Thus, the simplified magnetic flux flow 214C flows through the ends of the orthogonal polarized magnet 209C.

Figure 2C:
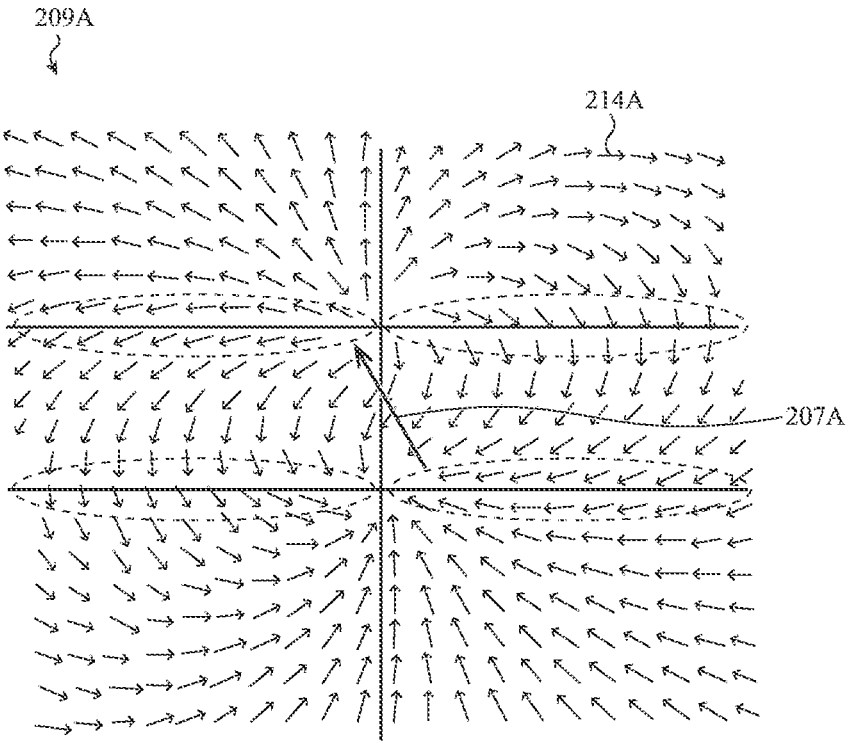
FIG. 2C depicts an elaborated view of the magnetic flux flow of the oblique angle polarized magnet of FIG. 2A.

FIG. 2C depicts an elaborated view of the magnetic flux flow 214A of the oblique angle polarized magnet 209A of FIG. 2A. In this elaborated view, the magnetic flux flow 214A of the oblique angle polarized magnet 209A is very different from a traditional orthogonal polarized magnet. As shown, the magnetic flux flow 214A flows in various field directions in different regions, flowing through the center of the oblique angle polarized magnet 209A and crossing the magnetic primary field line 207A.

Figure 3A:
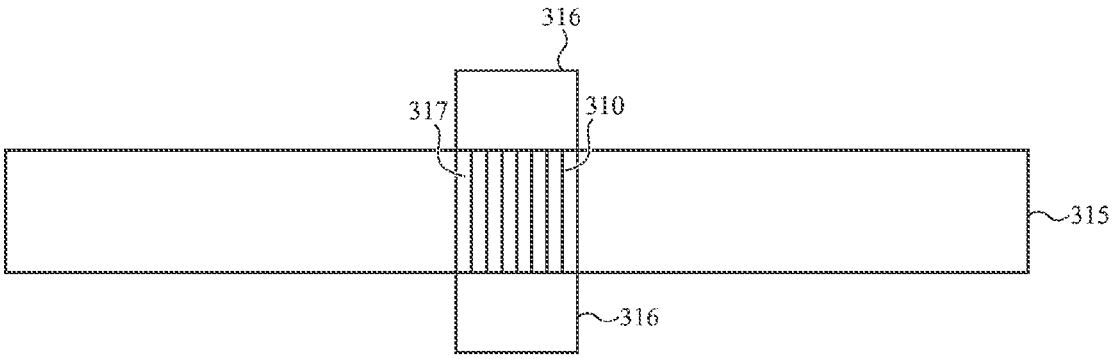
FIG. 3A depicts a first example operation in a first method of forming a magnetic element, such as an oblique angle polarized magnet, where a mass of magnetic material having a grain direction is formed.

Oblique angle polarized magnets or other magnetic elements may be formed in a variety of ways. FIG. 3A depicts a first example operation in a first method of forming a magnetic element, such as an oblique angle polarized magnet, where a mass of magnetic material 317 having a grain direction 310 is formed. The mass of magnetic material 317 may be formed by placing particles of magnetic material (such as neodymium, iron, boron, and so on) in a mold 315 and compressing and/or heating the particles using a press 316 such that a mass of magnetic material 317 with a grain direction 310 is formed. The grain direction 310 may be formed using magnetic force to line up the particles during compression and/or heating.

Figure 3B:
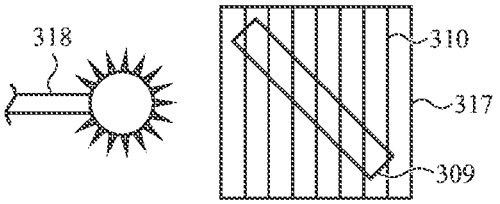
FIG. 3B depicts a second example operation in the first method of forming the magnetic element where magnetic material is removed from the mass of magnetic material to form a rectangular shaped mass having an attraction surface that is non-orthogonal to the grain direction.

FIG. 3B depicts a second example operation in the first method of forming the magnetic element where magnetic material is removed from the mass of magnetic material 317 to form a rectangular shaped mass 309 having an attraction surface that is non-orthogonal to the grain direction 310. A tool 318, such as a cutting or grinding tool 318, may be used to remove material from the mass of magnetic material 317 to form the rectangular shaped mass 309. However, this is an example. Any process that removes material to form the rectangular shaped mass 309 from the mass of magnetic material 317 (such as cutting, grinding, abrading, blasting, laser cutting, etching, and so on) may be used without departing from the scope of the present disclosure.

Figure 3C:
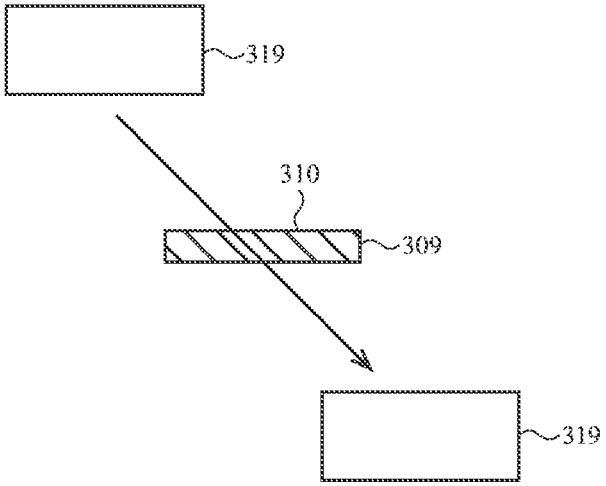
FIG. 3C depicts a third example operation in the first method of forming the magnetic element where the rectangular shaped mass is magnetized by subjecting the rectangular shaped mass to a strong magnetic field.

FIG. 3C depicts a third example operation in the first method of forming the magnetic element where the rectangular shaped mass 309 is magnetized to have a magnetic primary field line that is non-orthogonal to the attraction surface by subjecting the rectangular shaped mass 309 to a strong magnetic field using a magnetic field generating apparatus 319. The magnetic field generating apparatus 319 may subject the rectangular shaped mass 309 to a strong enough magnetic field that the rectangular shaped mass 309 is permanently magnetized, forming a magnetized rectangular shaped mass 309. The strong magnetic field may be aligned with the grain direction 310. However, it is understood that this is an example. In other implementations, the strong magnetic field may not be aligned with the grain direction 310.

Figure 4:
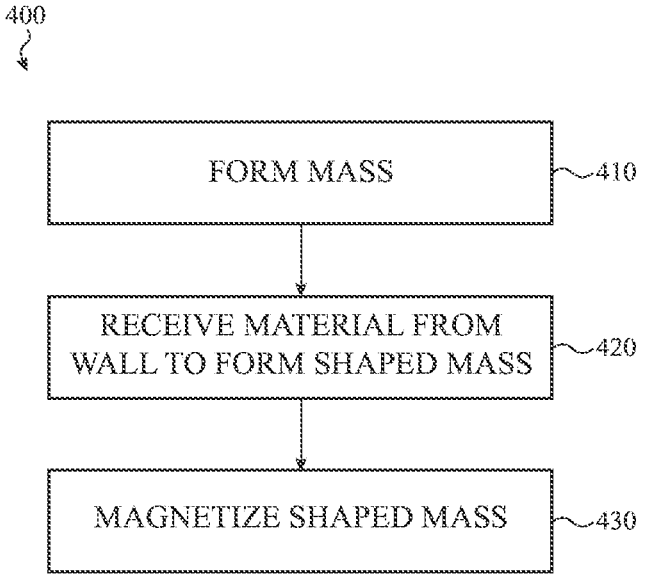
FIG. 4 depicts a flow chart illustrating a second method of forming a magnetic element, such as an oblique angle polarized magnet. The magnetic element may be the magnets/magnetic elements of FIGS. 1A-1B, 1D, 2A, 2C, and/or 3A-3C.

FIG. 4 depicts a flow chart illustrating a second method 400 of forming a magnetic element, such as an oblique angle polarized magnet. The magnetic element may be the magnets/magnetic elements of FIGS. 1A-1B, 1D, 2A, 2C, and/or 3A-3C.

At 410, a mass of magnetic material is formed. The mass may be formed by various processes. Such processes may include melting magnetic materials in a vacuum, allowing the melted magnetic materials to cool and solidify, grinding the magnetic materials into powder, pressing the powdered magnetic materials into a mass while a magnetic force is applied to direct the particles, heating the mass (such as to sinter, anneal, and so on), and so on.

At 420, material is removed from the mass of magnetic material to form a rectangular shaped mass with a grain direction non-orthogonal to an attraction surface. Any number of different cutting, grinding, shaping, and/or other processes may be used. At 430, the rectangular shaped mass is magnetized to have a magnetic primary field line that is non-orthogonal to the attraction surface. The mass may be magnetized by subjecting the rectangular shaped mass to a magnetic field. Further, the mass may be cut, diced, or otherwise separated into individual magnets, each with an external surface (e.g., attraction surface) that is not orthogonal (or parallel) to a grain direction of the magnet. Accordingly, multiple magnets may be formed from a single mass.

Although the example method 400 is illustrated and described as including particular operations performed in a particular order, it is understood that this is an example. In various implementations, various orders of the same, similar, and/or different operations may be performed without departing from the scope of the present disclosure.

For example, the method 400 is illustrated and described as forming the mass of magnetic material and then removing material to form the rectangular shaped mass. However, in various implementations, the mass may be formed as the rectangular shaped mass without first forming the mass prior to removing material.

Figure 5A:
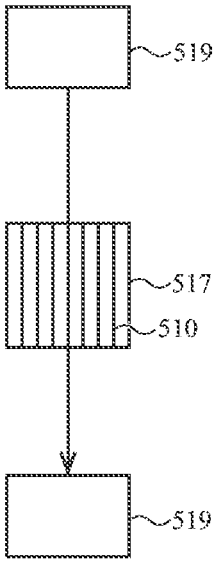
FIG. 5A depicts a first example operation in a third method of forming a magnetic element, such as an oblique angle polarized magnet, where a mass of magnetic material having a grain direction is magnetized by subjecting the mass to a strong magnetic field.

FIG. 5A depicts a first example operation in a third method of forming a magnetic element, such as an oblique angle polarized magnet, where a mass 517 of magnetic material having a grain direction 510 is magnetized by subjecting the mass 517 to a strong magnetic field. The strong magnetic field may be generated by a magnetic field generating apparatus 519. The strong magnetic field may be aligned with the grain direction 510. The strong magnetic field may permanently magnetize the mass 517.

Figure 5B:
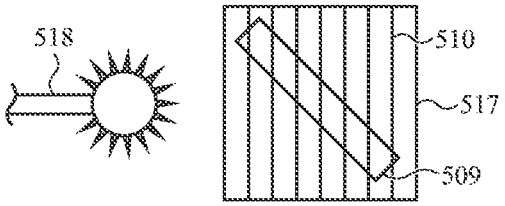
FIG. 5B depicts a second example operation in the third method of forming the magnetic element where magnetic material is removed from the magnetized mass of magnetic material to form a rectangular shaped mass having an attraction surface that is non-orthogonal to the grain direction.

FIG. 5B depicts a second example operation in the third method of forming the magnetic element where magnetic material is removed from the magnetized mass 517 of magnetic material to form a rectangular shaped mass 509 having an attraction surface that is non-orthogonal to the grain direction 510. The rectangular shaped mass 509 may also have a magnetic primary field line that is non-orthogonal to the grain direction 510. The material may be removed using a cutting tool 518 and/or any other process that removes material from the mass 517 to form the rectangular shaped mass 509.

Figure 6:
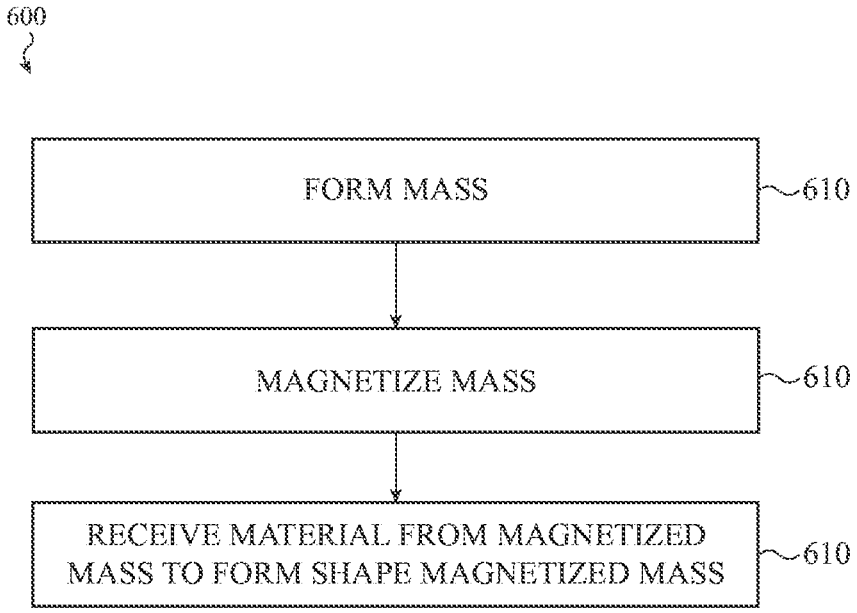
FIG. 6 depicts a flow chart illustrating a fourth method of forming a magnetic element, such as an oblique angle polarized magnet. The magnetic element may be the magnets/magnetic elements of FIGS. 1A-1B, 1D, 2A, 2C, 3A-3C, and/or 5A-5B.

FIG. 6 depicts a flow chart illustrating a fourth method 600 of forming a magnetic element, such as an oblique angle polarized magnet. The magnetic element may be the magnets/magnetic elements of FIGS. 1A-1B, 1D, 2A, 2C, 3A-3C, and/or 5A-5B.

At 610, a mass of magnetic material may be formed. The mass may have a grain direction. At 620, the mass may be magnetized. The mass may be magnetized using a magnetic field aligned with the grain direction. At 630, material may be removed from the magnetized mass to form a shaped magnetized mass. The removal may involve cutting, grinding, abrading, blasting, laser cutting, etching, and/or any other material removal process.

Although the example method 600 is illustrated and described as including particular operations performed in a particular order, it is understood that this is an example. In various implementations, various orders of the same, similar, and/or different operations may be performed without departing from the scope of the present disclosure.

For example, the method 600 illustrates operations 610-630 as separate, linearly performed operations. However, in various implementations, the mass may be shaped and magnetized simultaneously.

Figure 7:
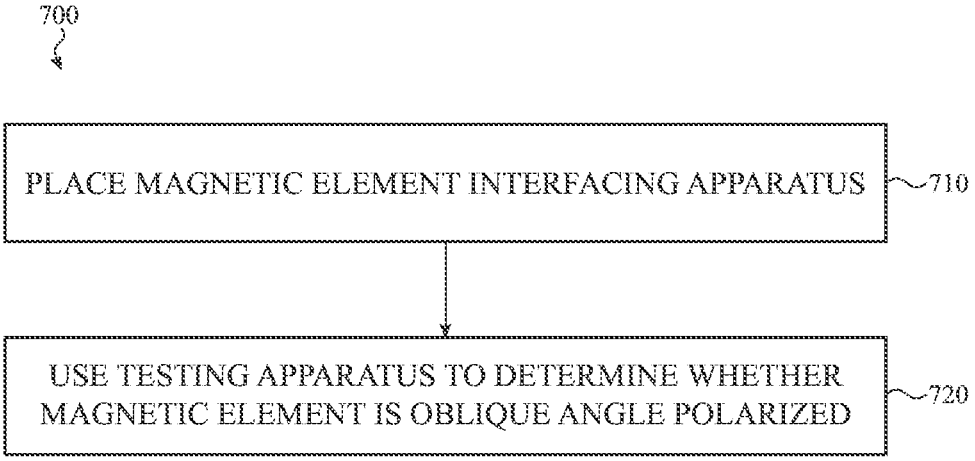
FIG. 7 depicts a flow chart illustrating a first method of testing a magnetic element for oblique angle polarization.

FIG. 7 depicts a flow chart illustrating a first method 700 of testing a magnetic element for oblique angle polarization. The method 700 may determine whether or not a magnetic element is oblique angle polarized, the polarization of an oblique angle polarized magnetic element, the angle of oblique angle polarization, the direction of oblique angle polarization, and/or other characteristics of oblique angle polarization.

At 710, a magnetic element may be placed in a testing apparatus. The testing apparatus may be one or more of the testing apparatuses discussed in more detail below and/or one or more other testing apparatuses.

At 720, the testing apparatus may be used to determine whether or not the magnetic element is oblique angle polarized. The testing apparatus may be used to verify the results of a manufacturing process that produces oblique angle polarized magnetic elements.

Although the example method 700 is illustrated and described as including particular operations performed in a particular order, it is understood that this is an example. In various implementations, various orders of the same, similar, and/or different operations may be performed without departing from the scope of the present disclosure.

For example, the method 700 is illustrated and described as determining whether or not the magnetic element is oblique angle polarized. However, in some implementations, various characteristics of oblique angle polarization may be evaluated instead of and/or in addition to determining whether or not the magnetic element is oblique angle polarized. Such characteristics may include, but are not limited to, the polarization of an oblique angle polarized magnetic element, the angle of oblique angle polarization, the direction of oblique angle polarization, and so on.

Figure 8A:
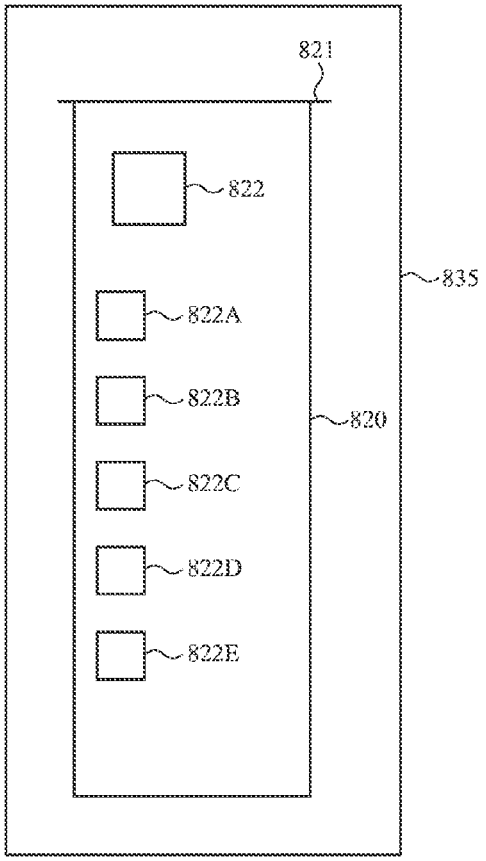
FIG. 8A depicts a top view of a first example of a testing apparatus used to test a magnetic element for oblique angle polarization.

FIG. 8A depicts a top view of a first example of a testing apparatus used to test a magnetic element 822A-822E for oblique angle polarization. In this first example, the testing apparatus is magnetic paper 835 having a reference indicator 821 for aligning a panel 820 that includes magnetic elements 822A-822E and a component 832, such as a Hall Effect sensor. The reference indicator 821 allows markings on the magnetic paper 835 to be evaluated with respect to where the magnetic elements 822A-822E were positioned.

Placing the panel 820 on the magnetic paper 835 positions the magnetic elements 822A-822E with their attraction surfaces facing the magnetic paper 835. Magnetic flux from the magnetic elements 822A-822E causes shadows or other marks to form on the magnetic paper 835, similar to a photographic negative. Thus, if the magnetic elements 822A-822E are orthogonal polarized, only the area above which the magnetic elements 822A-822E were positioned will be shadowed. Conversely, if the magnetic elements 822A-822E are oblique angle polarized, an area separated from the area above which the magnetic elements 822A-822E were positioned will be shadowed corresponding to the angle of the respective magnetic pole. As such, shadows on the magnetic paper 835 can be evaluated to determine whether the magnetic elements 822A-822E are orthogonal polarized or oblique angle polarized, the angle of oblique angle polarization, the direction of oblique angle polarization, and so on.

Figure 8B:
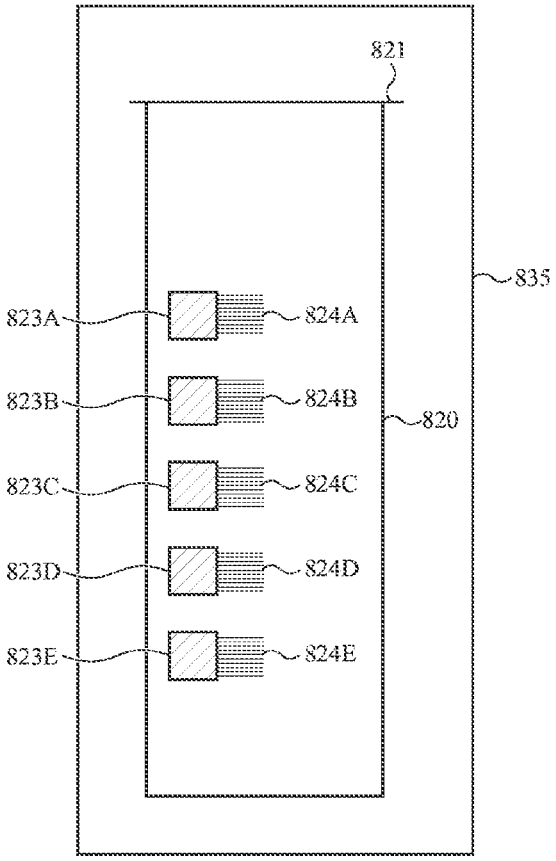
FIG. 8B depicts the first example testing apparatus of FIG. 8A after the magnet panel is removed from the magnetic paper.

FIG. 8B depicts the first example testing apparatus of FIG. 8A after the panel 820 is removed from the magnetic paper 835. The shadows 823A-823E correspond to the areas above which the magnetic elements 822A-822E were positioned. Further, the shadows 824A-824E extend from the shadows 823A-823E, separated by the non-shadowed areas 825A-825E. These shadows 824A-824E extending from the shadows 823A-823E and separated by the non-shadowed areas 825A-825E indicate that the magnetic elements 822A-822E are oblique angle polarized. Further, the direction that the shadows 824A-824E extend from the shadows 823A-823E indicate the angle and direction of those oblique angle polarizations.

Although FIGS. 8A-8B are illustrated and described as including a reference indicator 821, it is understood that this is an example. In various implementations, other means and mechanisms may be used to interpret shadows on the magnetic paper 835. For example, in some implementations, positions may be determined based on the pattern of the shadows without departing from the scope of the present disclosure.

Figure 9:
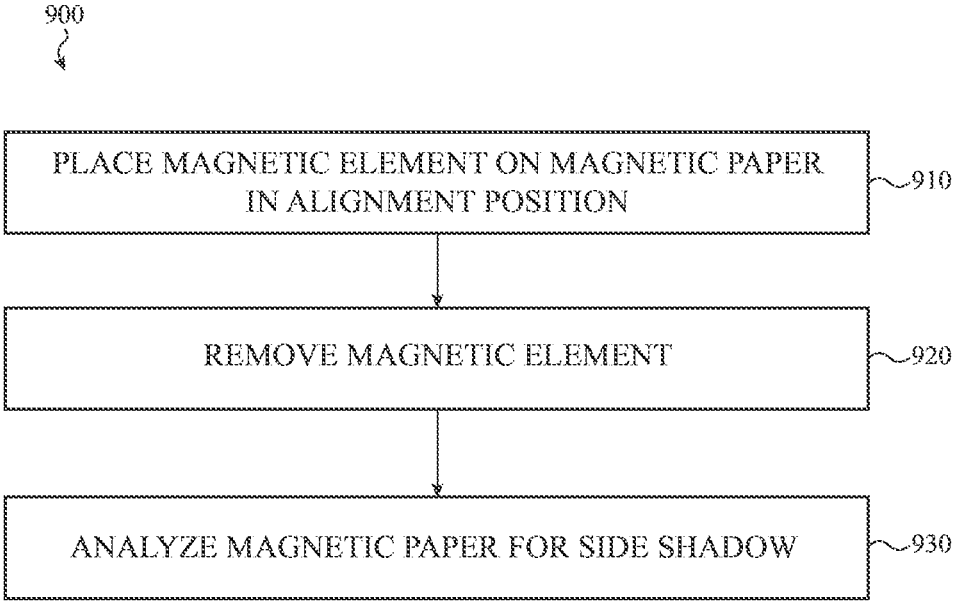
FIG. 9 depicts a flow chart illustrating a second method of testing a magnetic element for oblique angle polarization. The method may utilize the testing apparatus of FIGS. 8A-8B.

FIG. 9 depicts a flow chart illustrating a second method 900 of testing a magnetic element for oblique angle polarization. The method 900 may utilize the testing apparatus of FIGS. 8A-8B.

At 910, a magnetic element is placed on a magnetic paper. The magnetic element may be placed on the magnetic paper in an alignment position. Such an alignment position may be referenced to determine how shadows on the magnetic paper relate to where the magnetic element was placed. At 920, the magnetic element is removed from the magnetic paper.

At 930, the magnetic paper is analyzed. The magnetic paper may be analyzed for side shadows. Presence of side shadows may indicate that the magnetic element is oblique angle polarized. Conversely, absence of side shadows may indicate that the magnetic element is orthogonal polarized.

Although the example method 900 is illustrated and described as including particular operations performed in a particular order, it is understood that this is an example. In various implementations, various orders of the same, similar, and/or different operations may be performed without departing from the scope of the present disclosure.

For example, in various implementations, the area, direction, and/or position of side shadows may also be analyzed. These characteristics of side shadows may indicate the polarity, angle, and/or direction of the oblique angle polarization.

Figure 10A:
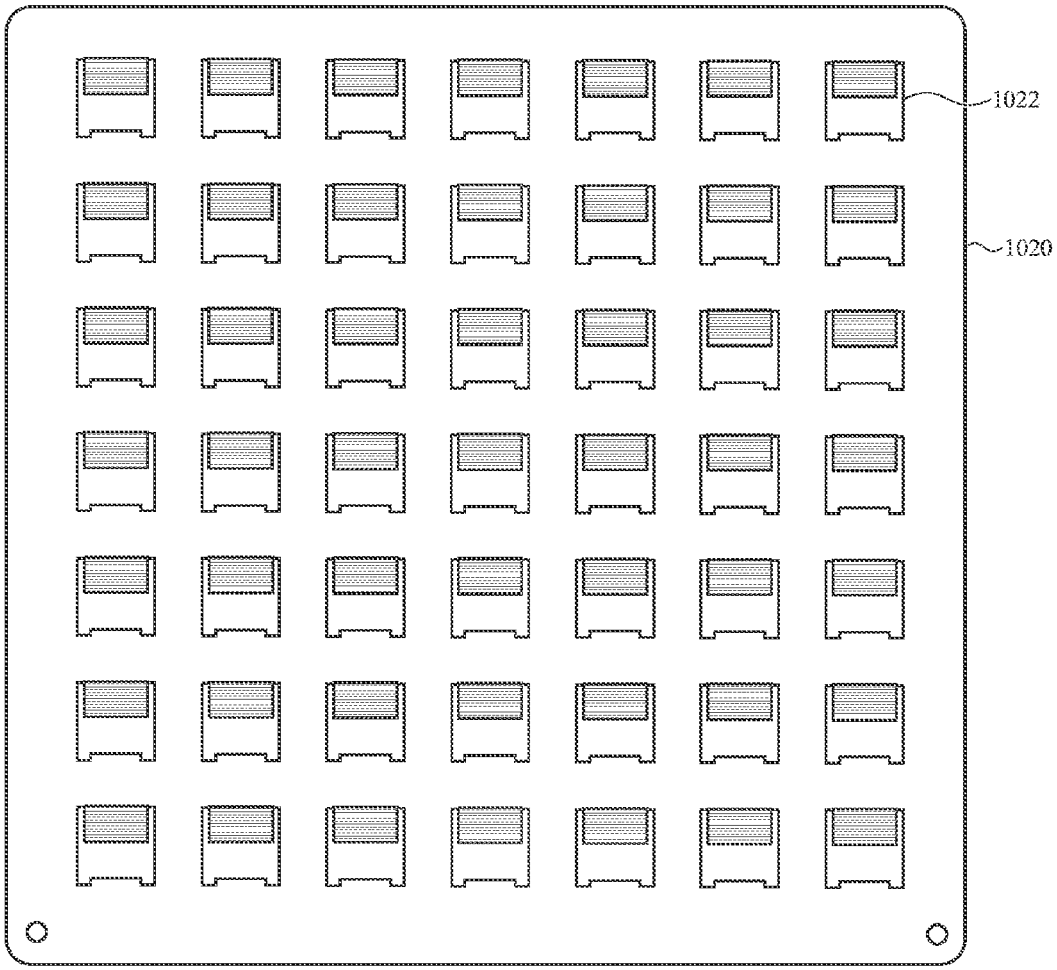
FIG. 10A depicts a top view of a second example of a testing apparatus used to test a magnetic element for oblique angle polarization.
Figure 10B:
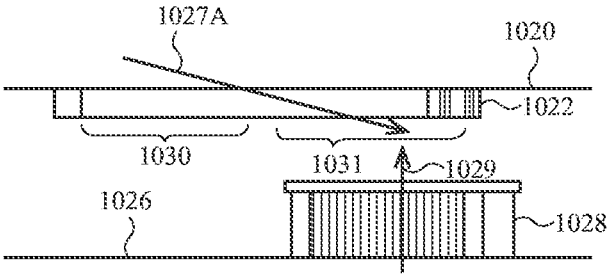
FIG. 10B depicts a side view of the second example testing apparatus of FIG. 10A illustrating the magnetic element having a first polarity orientation.

FIG. 10A depicts a top view of a second example of a testing apparatus used to test a magnetic element 1022 for oblique angle polarization. FIGS. 10B-10E depict side views of the example testing apparatus of FIG. 10A. With reference to FIGS. 10A-10E, in this example, the testing apparatus includes a panel 1020 of magnetic elements 1022 and a testing magnet 1028, having a magnetic primary field line 1029 orthogonal to its attraction surface, positioned on a base 1026. As illustrated in FIGS. 10B-10E, the testing magnet 1028 is positioned under a side (shown as side 1031 as opposed to side 1030) of the attraction surfaces of one of the magnetic elements 1022.

Figure 10C:
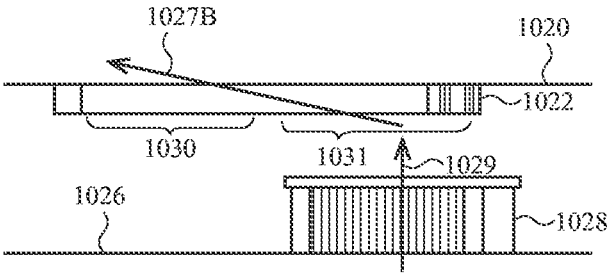
FIG. 10C depicts a side view of the second example testing apparatus of FIG. 10A illustrating the magnetic element having a second polarity orientation.
Figure 10D:
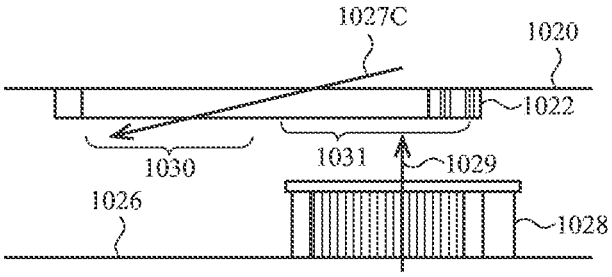
FIG. 10D depicts a side view of the second example testing apparatus of FIG. 10A illustrating the magnetic element having a third polarity orientation.
Figure 10E:
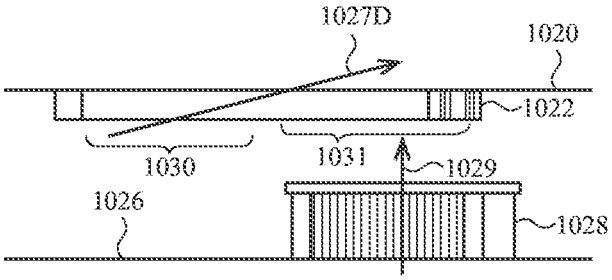
FIG. 10E depicts a side view of the second example testing apparatus of FIG. 10A illustrating the magnetic element having a fourth polarity orientation.

In this example, the testing magnet 1028 will attract the magnetic element 1022 if the magnetic element 1022 is configured with the magnetic primary field line 1027B illustrated in FIG. 10C (though the testing magnet 1028 will neither attract nor repel the magnetic element 1022 if moved adjacent the side 1030). If the magnetic element 1022 is configured with the magnetic primary field line 1027A illustrated in FIG. 10B, the magnetic element 1022 and the testing magnet 1028 will repel (though the testing magnet 1028 will neither attract nor repel the magnetic element 1022 if moved adjacent the side 1030). If the magnetic element 1022 is configured with the magnetic primary field line 1027C illustrated in FIG. 10D, the testing magnet 1028 will be too far from the magnetic field of the magnetic element 1022, needing to be positioned adjacent to the side 1030 instead of the side 1031, to repel. Conversely, if the magnetic element 1022 is configured with the magnetic primary field line 1027D illustrated in FIG. 10E, the testing magnet 1028 will be too far from the magnetic field of the magnetic element 1022, needing to be positioned adjacent to the side 1030 instead of the side 1031, to attract. In this way, the testing apparatus can be used to position the testing magnet 1028 adjacent to the sides 1030 and/or 1031 to determine that the magnetic element 1022 is oblique angle polarized, the polarization of the magnetic element 1022, and/or other information.

Figure 11:
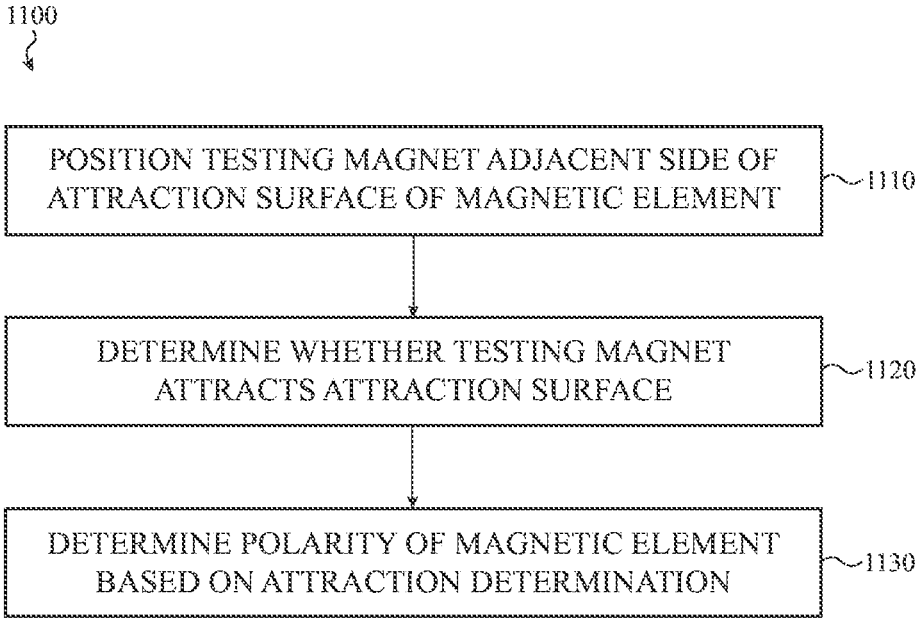
FIG. 11 depicts a flow chart illustrating a third method of testing a magnetic element for oblique angle polarization. The method may utilize the testing apparatus of FIGS. 10A-10E.

FIG. 11 depicts a flow chart illustrating a third method 1100 of testing a magnetic element for oblique angle polarization. The method 1100 may utilize the testing apparatus of FIGS. 10A-10E.

At 1110, a testing magnet is positioned adjacent to a side of an attraction surface of a magnetic element. The magnetic element may be positioned on a panel or other apparatus and the testing magnet may be coupled to a base or other apparatus such that the testing magnet is positionable with respect to the magnetic element.

At 1120, it is determined whether or not the testing magnet attracts the attraction surface. The testing magnet may attract the attraction surface of the magnetic element if the magnetic element is obliquely polarized opposite the polarization of the testing magnet in a direction extending away from the testing magnet. Whether or not the testing magnet repels the attraction surface and/or whether or not the testing magnet neither attracts nor repels the attraction surface may also be determined.

At 1130, the polarity of the magnetic element is determined based on the attraction determination. Other information regarding the magnetic element may also be determined, such as whether or not the magnetic element is oblique angle polarized, the angle of polarization, the direction of polarization, and so on.

Although the example method 1100 is illustrated and described as including particular operations performed in a particular order, it is understood that this is an example. In various implementations, various orders of the same, similar, and/or different operations may be performed without departing from the scope of the present disclosure.

For example, in various implementations, the testing magnet may also be positioned adjacent to another side of the attraction surface. The operation 1120 may then be repeated. In such an implementation, the determination at operation 1130 may utilize both sets of determinations.

Figure 12A:
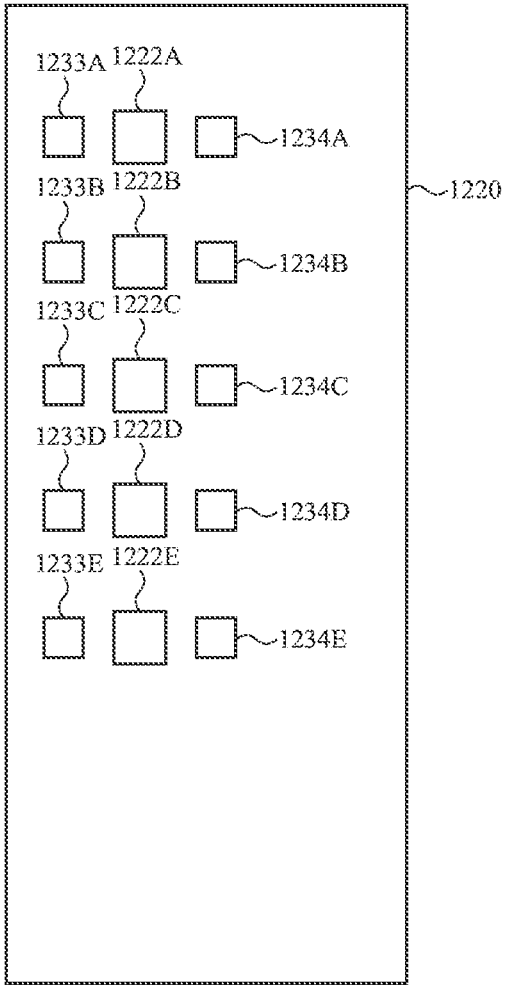
FIG. 12A depicts a top view of a third example of a testing apparatus used to test a magnetic element for oblique angle polarization.
Figure 12B:
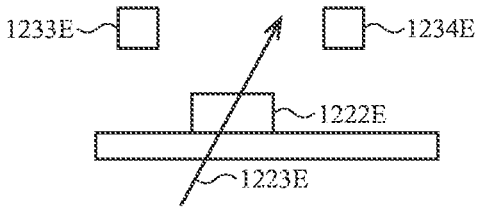
FIG. 12B depicts a side view of the third example testing apparatus of FIG. 12A illustrating the magnetic element having a particular polarity orientation.

FIG. 12A depicts a top view of a third example of a testing apparatus used to test a magnetic element 1222A-1222E for oblique angle polarization. In this third example, the testing apparatus includes at least two Hall Effect sensors 1233A-1233E, 1234A-1234E variously positioned about magnetic elements 1222A-1222E of a panel 1220 or other apparatus. FIG. 12B depicts a side view of the third example testing apparatus of FIG. 12A illustrating the magnetic element 1222E having a particular polarity orientation 1223E. With reference to FIGS. 12A-12B, the Hall Effect sensors 1233E, 1234E will be influenced differently by the particular polarity orientation 1223E of the magnetic element 1222E due to differing proximities to the oblique angle polarized magnetic field of the magnetic element 1222E. As such, signals from the Hall Effect sensors 1233E, 1234E may be evaluated and compared to determine that the magnetic element 1222E is oblique angle polarized, the angle of the magnetic primary field line of the magnetic element 1222E, the direction of the oblique angle polarization of the magnetic element 1222E, and/or other characteristics of the magnetic element 1222E.

Although FIG. 12B illustrates use of two Hall Effect sensors 1233E, 1234E for testing the magnetic element 1222E, it is understood that this is an example. In various implementations, other numbers of Hall Effect sensors 1233E, 1234E may be used. In some implementations, three, four, or more Hall Effect sensors 1233E, 1234E may be used without departing from the scope of the present disclosure.

Figure 13:
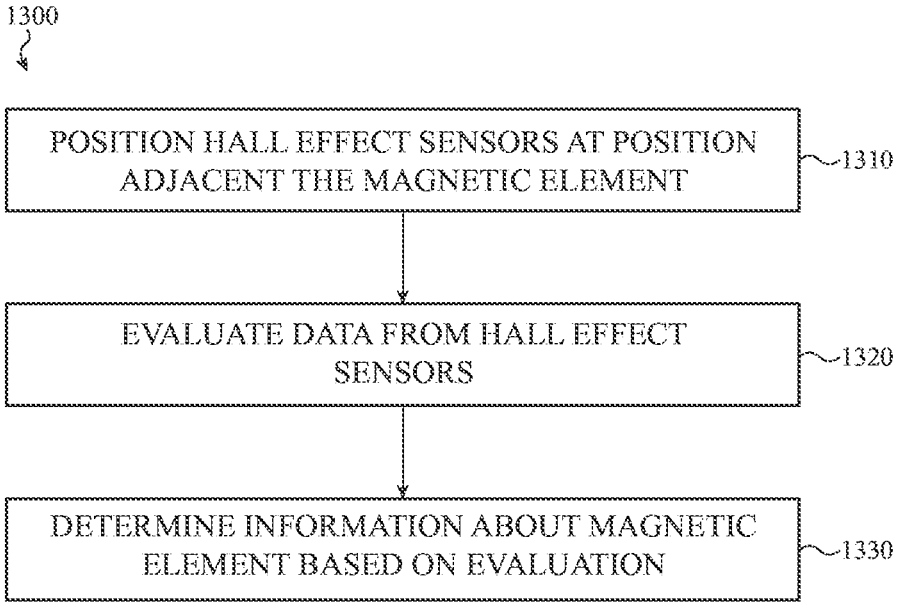
FIG. 13 depicts a flow chart illustrating a fourth method of testing a magnetic element for oblique angle polarization. The method may utilize the testing apparatus of FIGS. 12A-12B.

FIG. 13 depicts a flow chart illustrating a fourth method 1300 of testing a magnetic element for oblique angle polarization. The method 1300 may utilize the testing apparatus of FIGS. 12A-12B.

At 1310, Hall effect sensors are arranged at positions adjacent a magnetic element. The Hall Effect sensors may be positioned at opposing sides of the magnetic element. At 1320, data from the Hall Effect sensors is evaluated. The data from the respective Hall Effect sensors may be compared.

At 1330, information about the magnetic element is determined based on the evaluation. The information may include whether the magnetic element is oblique angle polarized or not, the angle of the magnetic primary field line of the magnetic element, the direction of the oblique angle polarization of the magnetic element, and/or other characteristics of the magnetic element.

Although the example method 1300 is illustrated and described as including particular operations performed in a particular order, it is understood that this is an example. In various implementations, various orders of the same, similar, and/or different operations may be performed without departing from the scope of the present disclosure.

For example, the example method 1300 is illustrated and described as determining information regarding a single magnetic element using the Hall Effect sensors. However, in various implementations, the same Hall Effect sensors may be utilized to simultaneously evaluate multiple magnetic elements without departing from the scope of the present disclosure.

As described above and illustrated in the accompanying figures, the present disclosure relates to oblique angle polarized magnets or other magnetic elements. Such magnets may include a rectangular magnetized permanent magnet having a grain direction, an attraction surface, and a magnetic primary field line that is orthogonal to the grain direction but non-orthogonal to the attraction surface. An oblique angle polarized magnet may be used in a magnetically positioned apparatus, such as a tablet computing device cover operable as a stand for the tablet computing device. The magnetically positioned apparatus may be configured to assume a position where first and second magnets are oriented in a non-parallel orientation such that the first and second surfaces of the magnets oriented at an acute angle with respect to each other. The magnets may facilitate the position.

In the present disclosure, the methods disclosed may be implemented as sets of instructions or software readable by a device. Further, it is understood that the specific order or hierarchy of steps in the methods disclosed are examples of sample approaches. In other embodiments, the specific order or hierarchy of steps in the method can be rearranged while remaining within the disclosed subject matter. The accompanying method claims present elements of the various steps in a sample order, and are not necessarily meant to be limited to the specific order or hierarchy presented.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of the specific embodiments described herein are presented for purposes of illustration and description. They are not targeted to be exhaustive or to limit the embodiments to the precise forms disclosed. It will be apparent to one of ordinary skill in the art that many modifications and variations are possible in view of the above teachings.

What is claimed is:

1. A magnetically positioned apparatus utilizing magnets to maintain a configuration, comprising:
- a first magnet, comprising:
  - a first surface; and
  - a first magnetic material having a first grain direction that defines a non-right, non-zero angle with respect to the first surface; and
  - a second magnet, comprising a second magnetic material having a second surface;
  - wherein the magnetically positioned apparatus is configured to assume a position where the first and second magnets are oriented in a non-parallel orientation such that the first and second surfaces are oriented at an acute angle with respect to each other; and the first and second magnets facilitate the position.

2. The magnetically positioned apparatus of claim 1, wherein the second magnetic material has a second grain direction that is orthogonal to the second surface.

3. The magnetically positioned apparatus of claim 2, wherein:
- the first magnet defines a primary field line; and
- the first magnet emits magnetic flux along the primary field line and at an oblique angle to the first surface.

4. The magnetically positioned apparatus of claim 3, wherein the primary field line is oriented at approximately a 90 degree angle from the second surface when the magnetically positioned apparatus is in the position.

5. The magnetically positioned apparatus of claim 1, wherein the second magnetic material has a second grain direction defining a non-right, non-zero angle with respect to the second surface.

6. The magnetically positioned apparatus of claim 1, wherein the magnetically positioned apparatus comprises a cover for an electronic device.

7. The magnetically positioned apparatus of claim 6, wherein the cover is coupleable to the electronic device.

8. The magnetically positioned apparatus of claim 7, wherein the cover further comprises
- a first housing portion; and
- a second housing portion;
- wherein the first magnet is attached to the first housing portion; the second magnet is attached to the second housing portion; and the first and second housing portions are oriented in a non-parallel orientation when the cover is in the position.

9. The magnetically positioned apparatus of claim 8, wherein the cover is operable as a stand for the electronic device when in the position.

10. The magnetically positioned apparatus of claim 8, wherein:
- the cover further comprises a third housing portion flexibly coupled to the second housing portion;
- the first housing portion is flexibly coupled to the second housing portion; and
- the first housing portion, the second housing portion, and the third housing portion form a triangle when the cover is in the position.

11. The magnetically positioned apparatus of claim 8, wherein the first magnet is embedded in the first housing portion.

12. A permanent magnet, comprising:
- magnetic material having:
  - a set of grains generally extending in a direction; and
  - an attraction surface defined by a substantially flat exterior surface of the permanent magnet; wherein
  - a magnetic primary field line extends, in the direction, through the magnetic material; and
- the direction is offset from the attraction surface by a non-right, non-zero angle.

13. The permanent magnet of claim 12, wherein the magnetic material is a non-cubic parallelepiped.

14. The permanent magnet of claim 12, wherein the magnetic material includes at least one of neodymium, iron, or boron.

15. The permanent magnet of claim 12, wherein the magnetic material is non-square.

16. The permanent magnet of claim 12, wherein the magnetic material is enclosed in a housing.

17. A magnetically positioned apparatus utilizing magnets to maintain a configuration, comprising:
- a cover for a tablet computing device, comprising:
  - a first cover portion;

a second cover portion; and a joint between the first cover portion and second cover portion;

a first magnet positioned in the first cover portion and defining a surface; and a second magnet, positioned in the second cover portion; wherein the cover is configured to bend at the joint; and a magnetic field line between the first magnet and second magnet extends at a non-right angle from the surface of the first magnet.

18. The magnetically positioned apparatus of claim 17, wherein a grain direction of the first magnet defines a non-right angle with respect to the surface of the first magnet.

19. The magnetically positioned apparatus of claim 17, wherein:

the joint is a first joint;

the cover further comprises:

a third cover portion; and a second joint connecting the second cover portion and third cover portion; and the first joint connects the first cover portion and third cover portion.

20. The magnetically positioned apparatus of claim 19, wherein the third cover portion is devoid of magnets.

21. The magnetically positioned apparatus of claim 19, wherein the second magnet defines a grain direction orthogonal to a surface of the second magnet.

22. The magnetically positioned apparatus of claim 17, wherein the cover is operable to couple to the tablet computing device.

* * * * *